US005511610A

United States Patent [19]

Lu

[11] Patent Number: 5,511,610

[45] Date of Patent: Apr. 30, 1996

[54] OFF-SET LOUVERED HEAT EXCHANGER FIN AND METHOD FOR MAKING SAME

[75] Inventor: James W. B. Lu, W. Bloomfield, Mich.

[73] Assignee: Behr Heat Transfer Systems, Walled Lake, Mich.

[21] Appl. No.: 213,255

[22] Filed: Mar. 15, 1994

[51] Int. Cl.[6] ..... F28D 1/02

[52] U.S. Cl. ..... 165/153; 165/152

[58] Field of Search ..... 165/152, 151, 165/153

[56] References Cited

U.S. PATENT DOCUMENTS

| | | | |
|---|---|---|---|
| 2,594,008 | 4/1952 | Getz | 165/153 |
| 2,652,233 | 9/1953 | Przyborowski | 165/153 |
| 3,250,325 | 5/1966 | Rhodes et al. | 165/153 |
| 3,810,509 | 5/1974 | Kun | 165/148 |
| 4,815,532 | 3/1989 | Sasaki et al. | 165/152 |
| 4,821,795 | 4/1989 | Lu | 165/151 |

FOREIGN PATENT DOCUMENTS

| | | | |
|---|---|---|---|
| 1521595 | 4/1968 | France | 165/153 |
| 0003895 | 1/1981 | Japan | 165/153 |
| 1030379 | 5/1966 | United Kingdom | 165/153 |

*Primary Examiner*—A. Michael Chambers
*Attorney, Agent, or Firm*—Howard & Howard

[57] ABSTRACT

A heat exchanger assembly (10) includes a pair of tanks (16, 18) with a plurality of flat-sided fluid tubes (20) extending between the tanks (16, 18). Fins (22) may be located externally between adjacent fluid tubes (20), and may be located internally within each fluid tube (20) for increasing heat exchange. The fins (22) are formed by a plurality of undulations (32) establishing lengths of walls (34) between peaks (36) of the undulations (32). The walls (34) include a plurality of slits (44) therein forming panels (42) between adjacent slits (44). The panels (42) are "randomly" deformed of various contours to extend at various distances from the walls (34) to increase heat exchange.

8 Claims, 3 Drawing Sheets

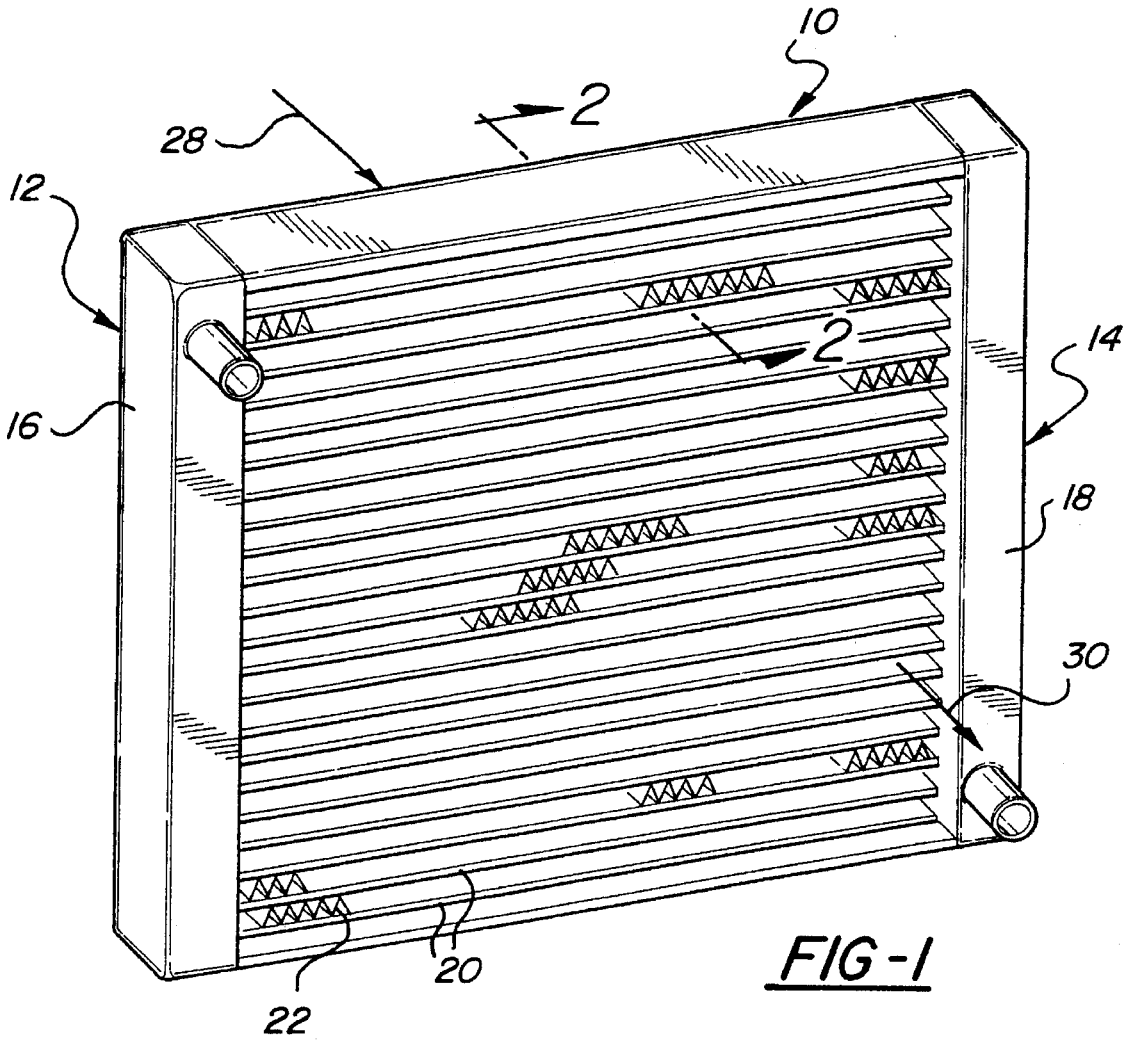
FIG-1
FIG-2
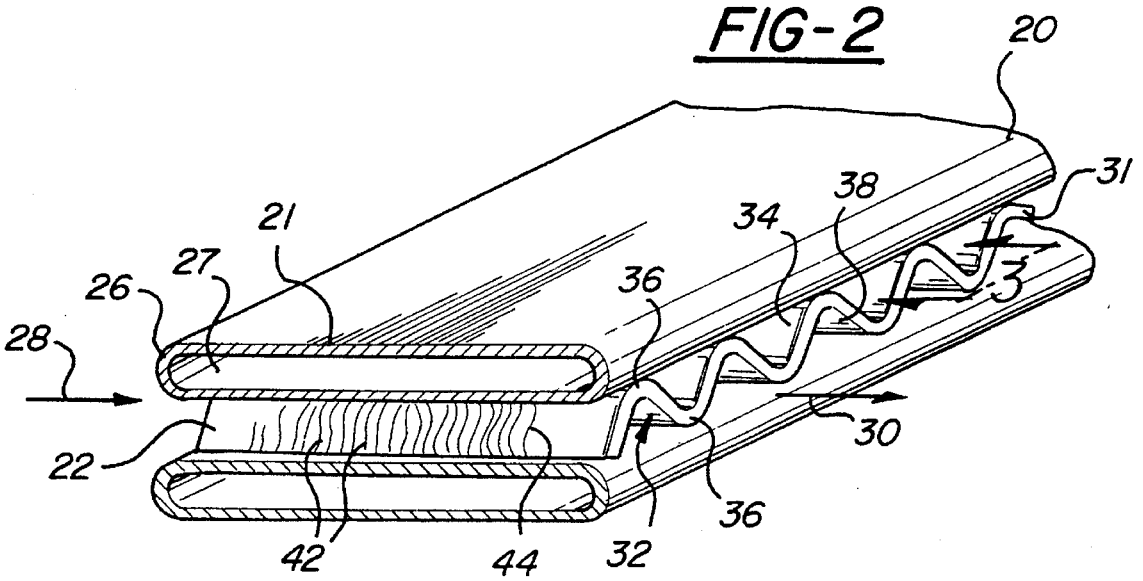

OFF-SET LOUVERED HEAT EXCHANGER FIN AND METHOD FOR MAKING SAME

TECHNICAL FIELD

The subject invention relates to heat exchangers of the type including two tanks in fluid communication through a plurality of fluid tubes extending therebetween, and fins connected between the fluid tubes to allow heat exchange with ambient air passing externally thereover.

BACKGROUND OF THE INVENTION

Commonly known in the art are heat exchangers used in connection with an automotive vehicle for cooling the engine thereof. The heat exchanger generally comprises an upper and lower manifold providing fluid reservoirs and a plurality of coolant tubes extending between the manifolds and providing fluid communication therebetween. Coolant passes through the upper and lower manifolds. These type of heat exchangers are liquid to air because liquid passes through the tanks and tubes while air is passed external and between the tubes for cooling the fluid therein.

There are air to air heat exchangers wherein air is passed within the tubes and air is passed externally thereover for heat exchange. This type of exchanger may be used in turbo charged engines wherein heat exchangers are routinely used for cooling compressed "charged" air from a turbocharger, on route to the cylinders for combustion.

Heat exchangers often include fin structures disposed between coolant tubes for directing the ambient air about the coolant tubes. Such fins enhance heat exchange performance and are common in the art as shown in U.S. Pat. No. 4,821,795 to Lu, assigned to the assignee of the subject invention. Furthermore, fins have also been disposed within the fluid tubes of heat exchangers. See for example, U.S. Pat. No. 4,815,532 issued Mar. 28, 1989 in the name of Sasaki et al.

In heat exchangers, it has been known to vary the configuration of the fins located between the fluid tubes to enhance air heat exchange. See for example, U.S. Pat. No. 3,810,509, issued May 14, 1974 in the name of Kun and U.S. Pat. No. 4,815,532, issued Mar. 28, 1989 in the name of Sasaki et al.

It is also known that the fins may be comprised of a sheet material having a plurality of undulations and angled louvers cut therein. The sheet is slit and the resulting sections are angled with respect to the flat sheet to cause turbulence of air flow therein. However, a problem with these types of angled louvers is that they require high air flow power because of high air pressure drop. The angled fins create Eddy currents on the back side of the fins which results in stagnant air flow and pressure loss.

With straight and continuous fins, there is a build-up of stagnant boundary layers on the surface of the fin. The boundary layers start from zero at the edge of the fin and increase along the length of the fin until fully developed to be thick layers of insulation. Therefore, the air passing through the fins is flowing over the top of this stagnant boundary layer and heat flow between the fin and the air has to be conducted through this layer of insulation which minimizes heat exchange rate. It is desirable to brake up the fin into small sections to prevent the boundary layer growth to reduce the overall stagnant boundary layer thickness, therefore to minimize the average thickness of the stagnant layer of the fin. It is desirable to allow air to pass through the fin structure easily, but it is also necessary to maximize the air flow to provide maximum heat transfer while reducing air resistance and pressure loss. Furthermore, manufacturing consideration must be taken into account to allow simple manufacture of a complex design.

SUMMARY OF THE INVENTION

The invention includes a heat exchanger assembly for exchanging heat with a cooling fluid. The assembly comprises first and second tanks, a plurality of fluid tubes connected between the first and second tanks for communicating fluid therebetween with the fluid tubes including tube walls, and fin means conductively connected between adjacent tube walls. The fin means comprise a plurality of undulations establishing lengths of walls extending between the tube walls forming air channels along the lengths of the undulations, the walls including a plurality of panels formed in the walls transverse to flow of air through the air channels, the panels formed in contours extending into one of the air channel with a contour different from the contour of an adjacent panel extending into the same air channel.

The invention also includes the panels extending into the air channel a distance different from an adjacent panel extending into the same air channel for increasing exchange of heat with air.

The invention also includes a method of making fins for a heat exchange assembly. The method includes the steps of: providing a sheet of heat conducting material; forming panels in the sheet by cutting a pair of spaced slits in the sheet and concurrently sloping one edge of the panel adjacent one of the slits with respect to the remaining edge of the panel adjacent the other slit; deforming selected ones of the angled panels to predetermined contours, and deforming the sheet into undulations having peaks with the panels formed between adjacent peaks.

Also included are the steps of: providing a sheet of heat conducting material; cutting panels in the sheet; deforming the panels to curved contours extending on one side of the sheet different from the contour of the next adjacent panel extending on the same side of the sheet.

Also included is an apparatus for making fin according to the above method including: cutting means for receiving a sheet of flat material, the cutting means including a plurality of adjacent cutting members for cutting slits in the sheet forming panels between adjacent slits and for concurrently deforming the panel angled with respect to the sheet.

The apparatus also includes cutting means for cutting a plurality of slits in the sheet forming panels between adjacent slits, and deforming means for deforming the panels in curved contours extending into one of the air channels with a contour different from the contour of an adjacent panel extending into the same air channel.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a heat exchanger assembly;

FIG. 2 is an enlarged perspective view taken along lines 2—2 of FIG. 1 showing the fluid tubes with fins between tubes;

DETAILED DESCRIPTION OF THE INVENTION

Figure 3:
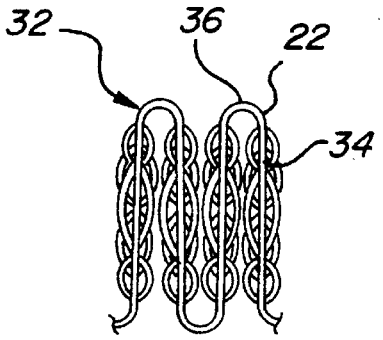
FIG. 3 is a cross sectional view of a fin taken along lines 3—3 of FIG. 2.

A heat exchanger of the type commonly used in connection with an automotive vehicle is generally illustrated at 10 in FIG. 1. The heat exchanger 10 comprises an upper 12 and lower 14 manifold providing upper 16 and lower 18 fluid reservoirs or tanks, respectively. A plurality of fluid tubes 20 extend between the tanks 16, 18 for communicating either a liquid or gas throughout the heat exchange assembly 10. A plurality of external fins 22 extend between the fluid tubes 20 in either air-to-air or liquid-to-air exchangers. Alternatively or in addition, fins of the same type described herein may also be provided within the fluid tubes 20 in an air-to-air exchanger, i.e., the fins are internal within each tube to increase heat exchange between the air passing through the tube and the tube itself.

In general, as a heated or charged fluid passes through the fluid tubes 20, heat is absorbed therefrom by a cooling fluid, preferably ambient air, flowing about the exterior of the fluid tubes 20. The cooling fluid exits from the assembly 10 at a higher temperature due to the exchange of heat with the fluid tubes 20. The charged fluid within the tubes 20 is thus cooled to a lower temperature and exits the assembly 10 by way of an outlet in the tank 16.

The external fins 22 are positioned between adjacent fluid tubes 20 for directing the cooling fluid about the outer portions of the fluid tubes 20. Internal fins may be positioned within each or selective fluid tubes 20 to cause an increase in heat exchange within the fluid tubes 20 with air flowing therethrough.

The fluid tubes 20 have opposing flat, elongated sides 21 as shown in FIG. 2. The flat sides 21 of the tubes 20 enhance heat exchange due to the large surface area of the tube 20 exposed to cooling fluid flowing externally about the tubes 20. Furthermore, the flat sides 21 allow the fluid tubes 20 to be stacked more closely together than, for instance, circular shaped tube. The fluid tubes 20 are comprised of tube walls 26 forming the fluid passageway 27 therein.

The fins 22 are utilized in any combination externally and/or internally, respectively, to increase the exchange of heat with air flowing across the fin 22.

The external fin 22 is positioned between the tube walls 26 of adjacent spaced fluid tubes 20 to allow air to flow thereacross from the air inlet side 28 of the heat exchanger 10 to the air outlet side 30 as illustrated in FIGS. 1 and 2.

The construction and design of the external fin 22 and internal fin are similar, and merely differ from their dimensions and positioning either as an external or internal fin as previously described. Therefore, the construction and design of the external fins 22 will be hereinafter described.

The fins 22 are formed from a thin metallic or conductive sheet 31 of material formed in a plurality of undulations 32 which establish straight lengths of walls 34 which extend between the tube walls 26, with the peaks 36 of the undulations 32 conductively connected to and contacting the flat sides 21 of the tube walls 26. The peaks 36 are generally brazed to the sides 21 of the walls 26. The undulations 32 form air channels 38 extending along the lengths of walls 34 of the undulations 32.

The walls 34 include a plurality of panels 42 formed therein extending from a position spaced from and between the peaks 36 of a wall 34. The panels 42 longitudinally extend transverse to the flow of air along the channels 38. Several of the panels 42 are manipulated or deformed to various contours or shapes different from the straight wall 34. Each panel 42 is formed by a pair of spaced, straight, longitudinal slits 44 cut into the sheet 31 extending between the peaks 36. The majority of the panels 42 are stamped or deformed into a different bent contour, as illustrated in FIGS. 5–10. It is to be understood that the slits 44 need not be straight, and various contours and dimensions may be utilized to practice the invention.

Figure 4:
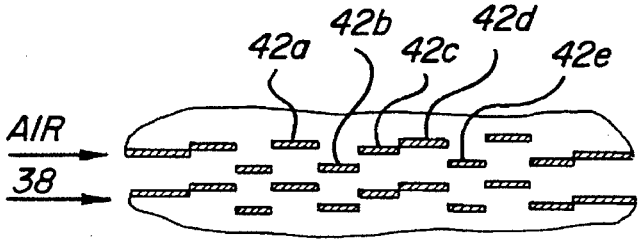
FIG. 4 is a schematic view of two adjacent fin walls illustrating the path of air flow through the spaced fin panels along the path from left to right.
Figure 5:
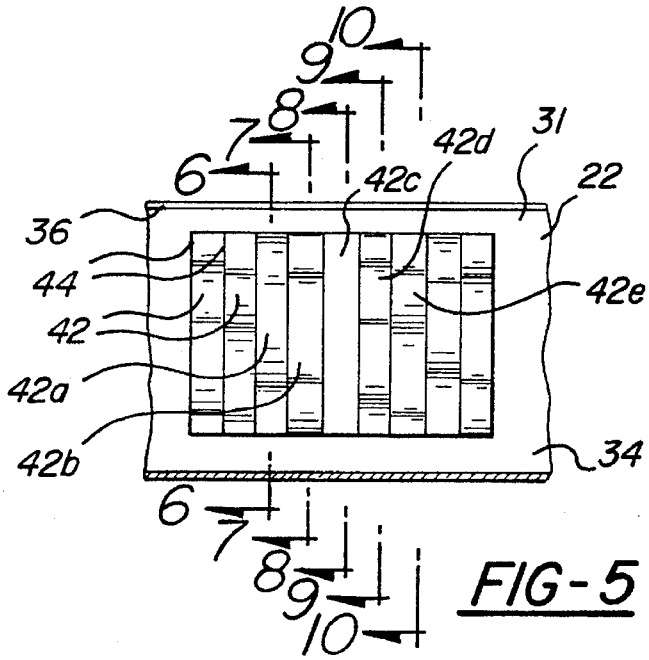
FIG. 5 illustrates a wall of an undulation of the fin showing the panels.
Figure 6:
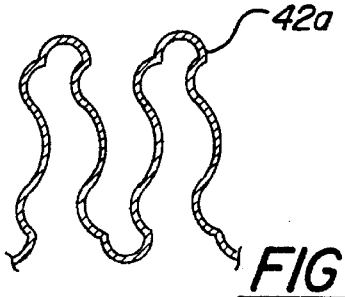
FIGS. 6–10 are detailed cross sections taken along respective lines of FIG. 5.
Figure 7:
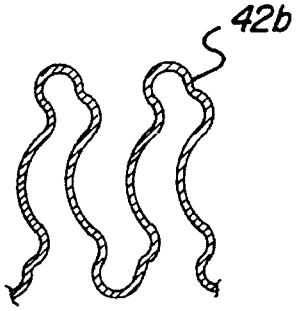
Figure 8:
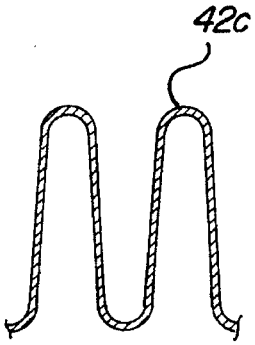
Figure 9:
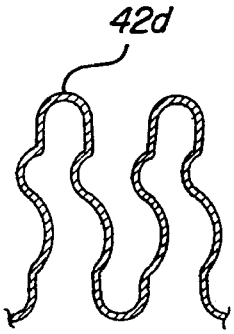
Figure 10:
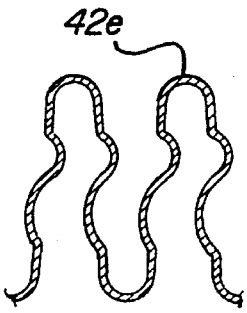

Each panel 42 is of a different contour from an adjacent panel 42*a–e*. (See FIGS. 6–10). A panel 42 which extends into the one air channel 38 is different from an immediate sequential or adjacent panel 42 which extends into the same channel 38 for increasing the exchange heat with air. In other words, every two closest positioned panels 42 which extend into the same channel 38, have a different contour and extend into the channel 38 a different distance from the straight wall 34 of the undulation 32; see for example the following pairs of panels, 42*a* and 42*b*, 42*d* and 42*e*, 42*e* and 42*a*. Various design considerations are illustrated in FIG. 6–10. However, it is to be understood that these curvatures may be altered as desired. It is important that the air flowing through the channel 38 be broken up in a somewhat random manner while allowing free air flow through the fin 22, 24, as illustrated in FIG. 4. By interrupting the air flow "randomly", an increase in heat transfer occurs. By extending adjacent panels 42 of different configurations into a channel 38, identifiable and continuous air paths do not occur, and the stagnant boundary layer is minimized. An increase in air pressure is avoided while allowing increase in heat exchange since the air direction is not changed as with the prior art angled louvers.

Also included is a method and apparatus 50 for making the fins 22, 24 thereof. As illustrated in FIGS. 11–14, the apparatus includes a cutting means 52 for cutting the panels 42 in the sheet 31 of metallic material, and deforming means 54 for forming the desired contours in the panels 42. Undulating means 82 (FIG. 14) receives the sheet 31 with formed panels 42 and provides the undulations 32 therein, which means 82 is commonly known in the art.

Figure 11:
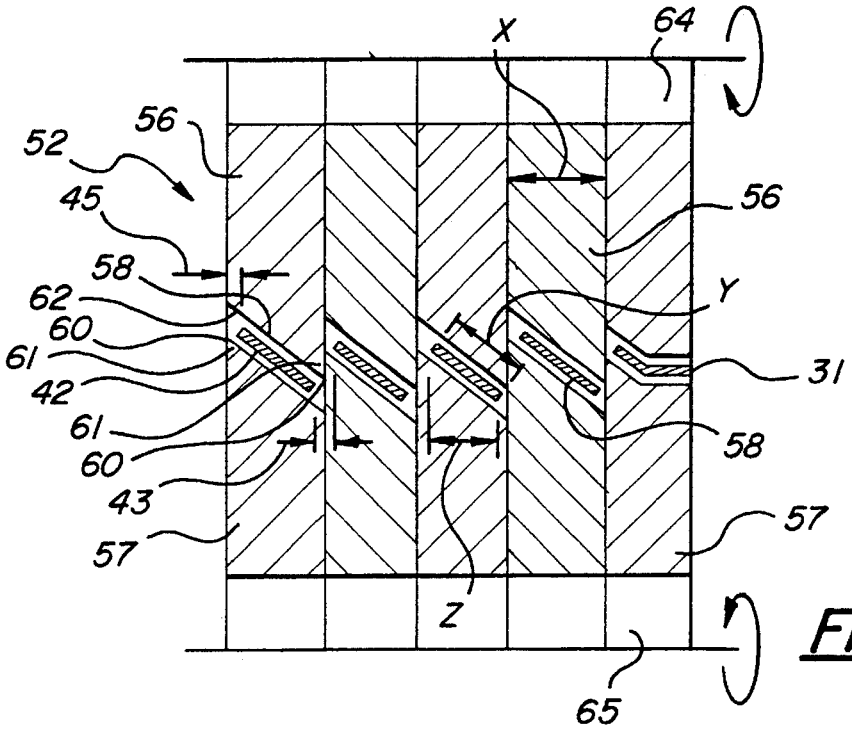
FIG. 11 is a schematic diagram illustrating the cutting means.
Figure 13:
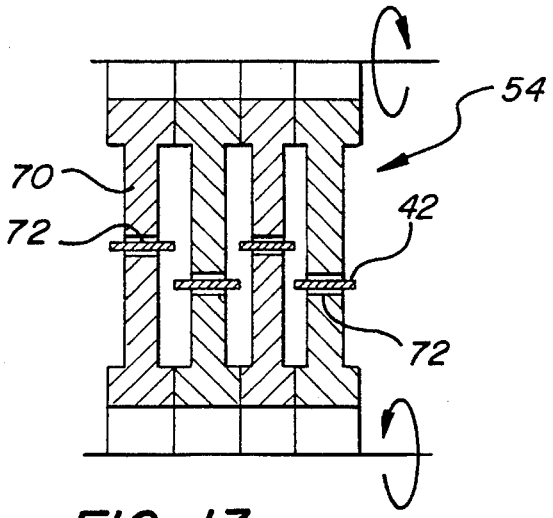
FIG. 13 is a schematic diagram illustrating the deforming means.

As illustrated in FIG. 11, the cutting means 52 comprises a plurality of adjacent cutting members 56, 57. Each of the cutting members 56 include a transverse, angled or sloping end 58. The cutting members 56, 57 are configured to the width and length of the desired panel 42. The cutting members 56, 57 include a longitudinally extending retracted edge 62 and a spaced and parallel, projecting edge 61. The retracted 62 and projecting 61 edges form opposite sides of the sloping end 58. The projecting end 61 includes a cutting blade 60 for cutting the sheet 31. The cutting blade 60 is at the tip of the angled end 58. The slits 44 are cut by the blades 60, and the angled end 58 deforms the panel 42 to an angle with respect to the remainder of the sheet 31. Angling of the panel 42 allows a gap 43 to be formed between adjacent panels 42, and a gap 45 to be formed between the edge of the panel 42 and the respective edge of the cutting member 56, 57. In other words, the width X of the cutting member 56, 57 is substantially equivalent to the width Y of the panel 42 when cut, and rotating the panel 42 to an angle with respect to the remainder of the sheet 31 by the angled end 58 provides the gap 45. The gap 45 results from the horizontally projected width z of the angled panel 42 being smaller than the width x of the cutting member 56, 57. This prevents each of the second cutting edges 62 from catching on the panel 42 adjacent thereto when fin is being stripped off from the rolling tools, which is also provided by the panels 42 being formed to an angle upon cutting.

Figure 12:
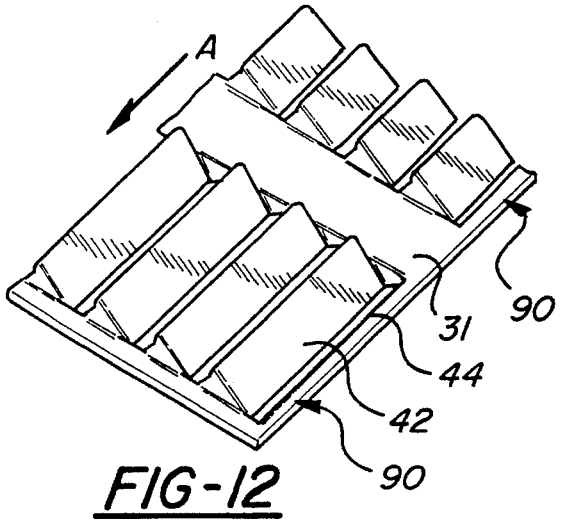
FIG. 12 is a cut away perspective view of the cut sheet produced by the cutting means.

The cutting members 56, 57 may be connected to and formed on mating roll-type cutters or wheel 64, 65, which roll along the flat, solid sheet 31 (i.e., rolling in a direction out of the paper) forming the cuts or slits 44 as illustrated in FIGS. 11–12 (only a representative number of members 56, 57 are illustrated). The cutting members 56 roll lengthwise along the sheet 31 (in the direction of arrow A in FIG. 12) and form the resulting slits 44 and panels 42 of FIG. 12. The projecting ends 61 of adjacent, opposing cutting members 56, 57 mate in a slicing or scissor manner to cut the sheet 31. The wheels 64, 65 both comprise complimenting cutting members 56, 57 to allow cutting and angling of the panels 42 with the blades 60 slicing in a scissor manner to cut the slits 44 and the angled ends 58 pressing against one another to form the panel 42 on the angle. Alternatively, the cutting members 56 of the same configuration may be positioned on mating stamping members (not shown) wherein the mating stamping member 56 come together upon cutting.

Figure 14:
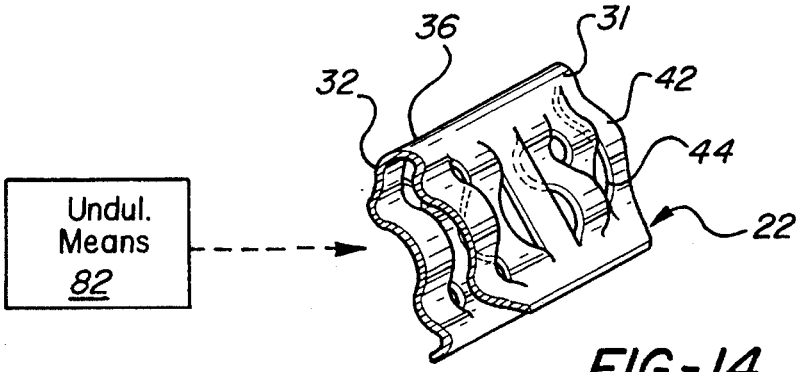
FIG. 14 is a diagram illustrating the undulating means and final fin.

The deforming means 54 comprises a plurality of mating, deforming members 70 for deforming each of the panels 42 to the desired contour. The deforming members 70 are spaced from one another and have a width less than the width of each panel 42 to insure that adjacent deforming members 70 and panels 42 do not catch on adjacent panels 42. The ends 72 of the members 70 are of a contour or configuration to stamp the respective shapes of 42*a–e* in FIGS. 5–10 in the panels 42. For example, as illustrated, five different contours are utilized (42*a–e*), and therefore five sequential members 70 will be of different contours from one another, matching the contours of 42*a–e*. As with the cutting means 52, the deforming means 54 may also be positioned on engaging rollers or may be merely a press punch operation. The stamped sheet 31 is then fed through the undulating means 82 which bends the cut and formed sheet 31 into a plurality of undulations to produce the fin 22 as illustrated in FIG. 14.

The means 52 and 54 allow a flat sheet 31 of material to be easily and consistently cut into the panels 42, and subsequently stamped or deformed into the desired contours of FIGS. 6–10, by a roll or stamping process and apparatus.

The method of making the fins 22 includes the steps of providing a flat sheet 31 of metallic material, cutting a plurality of spaced slits 44 in the sheet 31 along a plurality of spaced rows 90, concurrently angling the panels 42 formed between spaced slits 44 upon cutting thereof, deforming the panels 42 to predetermined "random" shapes with respect to adjacent panels 42. The shape and contours of the panels 42 were previously discussed. Thereafter, the sheets 31 are bent into the undulation 32 with the peaks 36 thereof between the rows 90. The formed fins 22 are connected or brazed to the tube walls, either internally or externally as required.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly (10) for exchanging heat with a cooling fluid, said assembly comprising:

first and second tanks (16, 18);

a plurality of fluid tubes (20) connected between said first and second tanks (16, 18) for communicating fluid therebetween, said tubes (30) include tube walls (26);

fin means (22) conductively connected between adjacent of said tube walls (26);

said fin means (22) comprising a plurality of undulations (32) establishing lengths of wall (34) extending between said tube walls (34) and forming air channels (38) on opposing sides of said walls (34) along the lengths of said undulations (32), said walls (34) including a plurality of panels (42) formed in said walls (34) transverse to flow of air through said air channels (38), and characterized by each of said panels (42) formed in contours extending at least partially into each of said air channels (38) on opposing sides of said walls (34) and having a contour different from the contour of an adjacent panel (42) extending into each of said same air channels (38).

2. An assembly as set forth in claim 1 wherein at least three of adjacent ones of said panels (42) are comprised of different contours from one another and each of said panels (42) having a different contour extending at least partially into each of said air channels (38) formed on opposing sides of said wall (34).

3. An assembly as set forth in claim 2 wherein said fluid tubes (20) include said fin means (22) within said tube walls (26) of at least one fluid tube.

4. An assembly as set forth in claim 3 wherein said fin means (22) being connected between adjacent and spaced fluid tubes (20).

5. A heat exchanger assembly (10) for exchanging heat with passing air, said assembly comprising:

first and second tanks (16, 18);

a plurality of fluid tubes (20) connected between said first and second tanks (16, 18) for communicating fluid therebetween, said tubes (20) include tube walls (26);

fin means (22) conductively connected between adjacent of said tube walls (26);

said fin means (22) comprising a plurality of undulations (32) establishing lengths (34) extending between said tube walls (26) and forming air channels (38) on opposing sides of said walls (34) along the lengths of said undulations (32), said lengths (34) including a plurality of panels (42) formed in said lengths (34) transverse to flow of air through said air channels (38), and characterized by each of said panels (42) having at least a portion extending into each of said air channels (38) on opposing sides of said lengths (34) a distance different from an adjacent panel (42) extending into each of the same air channels (38) for increasing exchange of heat with air.

6. An assembly as set forth in claim 5 wherein at least three of adjacent one of said panels (42) having a portion extend into each of said air channels (38) a distance different from each other of said three adjacent panels (42).

7. An assembly as set forth in claim 6 wherein said fluid tubes (20) include said fin means (22) within said tube walls (26) of at least one fluid tube.

8. An assembly as set forth in claim 6 wherein said fin means (22) are connected between spaced fluid tubes.

* * * * *